US005369809A

United States Patent [19]

Hall

[11] Patent Number: 5,369,809

[45] Date of Patent: Dec. 6, 1994

[54] ADJUSTABLE HOOD SYSTEM

[75] Inventor: Robyn Hall, Portland, Oreg.

[73] Assignee: Nike, Inc., Beaverton, Oreg.

[21] Appl. No.: 60,647

[22] Filed: May 13, 1993

[51] Int. Cl.[5] ..... A42B 1/22

[52] U.S. Cl. ..... 2/202; 2/84; 2/419

[58] Field of Search ..... 2/84, 171, 183, 202, 2/197, 204, 205, 195.2, 195.3, 195.4, 417, 418, 419, 420

[56] References Cited

U.S. PATENT DOCUMENTS

| | | | |
|---|---|---|---|
| 48,867 | 7/1865 | Hill . | |
| 121,391 | 11/1871 | Love . | |
| 284,511 | 9/1883 | Stern . | |
| 430,473 | 6/1890 | Heidelberger | 2/204 |
| 1,992,285 | 2/1935 | Blum | 2/183 |
| 2,560,598 | 7/1951 | Rinis . | |
| 2,567,192 | 9/1951 | De Grazia | 2/84 |
| 2,581,366 | 1/1952 | De Grazia | 2/84 |
| 2,624,052 | 1/1953 | Redlin | 2/204 |
| 2,679,647 | 6/1954 | Gossner | 2/84 |
| 4,138,743 | 2/1979 | Elkins et al. | 2/202 |
| 4,599,749 | 7/1986 | Childs | 2/204 |

FOREIGN PATENT DOCUMENTS 1291012 3/1962 France ..... 2/84

OTHER PUBLICATIONS

Nike Men's Apparel Catalog Fall 1991, pp. 160–161.
Patagonia 1992 Clothing Brochure, esp. pp. 10–11.
Marmot Mountain International, Inc. Spring/Summer 1983 Catalog, p. 12.
Marmot Fall/Winter 1992–1993 Catalog, pp. 12, 14, 15, 21 and 24.
The North Face Spring 1993 Catalog, pp. 58, 60 and 61.

*Primary Examiner*—Clifford D. Crowder
*Assistant Examiner*—Diana L. Biefeld
*Attorney, Agent, or Firm*—Banner, Birch, McKie & Beckett

[57] ABSTRACT

An adjustable hood system including a pair of drawstrings extending from the two temple areas of the wearer to the area corresponding to the nape of the neck. The drawstrings provide both vertical and lateral adjustability around the head of the wearer to allow the wearer to customize the fit of the hood, regardless of the size of the wearer's head or the amount of layers of headgear under the hood. The drawstrings are contained by a single cordlock so that the desired fit is achieved and maintained around the wearer's head with one simple operation of the drawstrings.

27 Claims, 3 Drawing Sheets

ADJUSTABLE HOOD SYSTEM

FIELD OF THE INVENTION

This invention pertains to an adjustable hood system for outerwear possessing optimal adjustability to provide a snug fit for various head sizes, layering of headgear, and multiple conditions of use.

BACKGROUND OF THE INVENTION

Hoods for outerwear garments typically having a face opening and drawstring provided in a passageway around the periphery of the face opening. The ends of the drawstring extend out of the passageway and are used to adjust the size of the face opening. When the ends of the drawstring are pulled and tightened, the face opening of the hood is made smaller, and no other adjustment of the hood, either in the lateral or vertical direction is available to accommodate the wearer's head size or the added bulk of other gear that may be under the hood.

To alleviate the above-mentioned shortcoming of the conventional face opening drawstring, hoods have been developed with various other adjustment features designed to better fit the head of the wearer.

U.S. Pat. No. 2,679,647 to Gossner discloses a hood having an external buckle and strap arrangement for providing vertical adjustment to the hood to adjust the forward edge of the hood with respect to the face of the wearer.

U.S. Pat. No. 2,567,192 to De Grazia discloses a hood adjustment having an oversize head covering portion with an inverted "V"-shaped channel at the rear of the hood that contains a drawstring secured at each end of the inverted "V". The free end of each drawstring is pulled separately or in conjunction with the second drawstring so that the anchored ends are drawn toward each other and pull the central portion of the hood down toward the base of the neck.

U.S. Pat. No. 2,560,598 to Rinis discloses a criss-crossing shoelace-type lacing arrangement at the rear neck area of a parka hood on opposing external flaps. This lacing arrangement provides primarily a lateral adjustment of the hood in the base of the neck area.

*THE NORTH FACE* Spring 1993 catalog at pages 58, 60 and 61 discloses a hood adjustment system that utilizes a flat webbing with an adjustable buckle/slider element on each side of the face opening of the hood at eye level. The webbing is set back from the edge of the face opening and is threaded through the buckle/slider to provide lateral adjustment of the hood. The buckle/slider system has limited adjustability and may interfere with peripheral vision.

A Spring-Summer 1983 *MARMOT* publication at page 12 discloses a parka hood having two hidden elastic bands to fit the hood securely to the head. The elastic bands are attached to the internal seam allowances at the temple area and to the lining seams of the central panel of the hood.

The *MARMOT* 1992–1993 Catalog discloses three different hood systems. The first type of adjustment system is disclosed on page 21, and uses a simple hook and loop strap on the back of the hood which provides a vertical manipulation of the hood. The second adjustment system is disclosed on page 24 and incorporates elastic bands that pass laterally from the left temple to the fight temple between the outer shell and lining of the hood. The elastic bands are joined to a conventional face opening drawstring for providing lateral adjustability of the hood. The third adjustment system is disclosed on pages 12, 14 and 15, and comprises a "Y-shaped" Lycra panel inset within the woven hood lining. The arms of the Lycra "Y" extend laterally toward each temple to provide an unfixed and an unstable elastic fit in both the lateral and vertical directions.

The Fall 1991 *NIKE Men's Apparel* Catalog at pages 160–161 discloses the Nike ACG Multi-Day Gore-tex Jacket which incorporated a "Y-shaped" Lycra panel inset within the hood lining. The hood of the Nike ACG jacket also provides, like the above *MARMOT* system, an unfixed and unstable elastic fit in both the lateral and vertical directions.

None of the above-described references discloses a hood having an adjustment system which provides optimal adjustability in both the lateral and vertical directions for fitting various head sizes and layering of headgear under the hood, or to adapt to multiple conditions of use.

SUMMARY OF THE INVENTION

Accordingly, it is the principal object of the present invention to provide an improved adjustable hood system which provides both vertical and lateral adjustability as well as adjustment of the degree of peripheral vision at the temple area to allow the wearer to customize the fit of the hood taking account of the size of the wearer's head, headgear under the hood, and multiple conditions of use, This and other objects are achieved by an adjustable hood system in accordance; with the present invention.

In one aspect, the hood has at least one panel of flexible material forming the hood in a shape for covering the crown, back and sides of a wearer's head; a face opening for leaving exposed the wearer's face; and a drawstring arrangement for simultaneously adjusting the fit of the hood in both lateral and vertical directions. The drawstring arrangement comprises a pair of arcuate passageways formed in the material and extending from a lower rear portion of the hood corresponding approximately to the nape of the neck of the wearer, to respective upper forward portions of the hood, on opposite sides of the face opening, corresponding approximately to the temple areas of the wearer. A pair of drawstrings extend along the passageways and are secured at first ends thereof to the hood. Second ends of the drawstrings extend externally of the passageways, whereby the fit of the hood may be adjusted by pulling on the second ends of the drawstrings.

In another aspect, the hood is disposed on a collar and made of a flexible material forming a shape for covering the crown, back and sides of a wearer's head. A face opening is provided for leaving a portion of the wearer's face exposed. Adjusting means are provided for adjusting the degree of peripheral vision at the temple areas of the hood while simultaneously adjusting the fit of the hood in both lateral and vertical directions. The adjusting memos extend approximately from the nape of the neck area of the wearer to the temple areas of the wearer.

Providing adjustability in both the lateral and vertical directions will accommodate a variety of head sizes and body proportions. Additionally, the design will allow a wearer to optimally adjust the face opening to eliminate any obstruction at eye level to thereby maximize peripheral vision. The two-way adjustability will also provide an optimal fit to a wearer having layers of headgear on under the hood, such as insulation, a helmet, etc.

The hood adjustment system of the present invention is simple in construction, and adjustment only requires a singular motion by the wearer. The hood adjustment system of the present invention operates independently of any conventional hood drawcord extending around the face opening of the hood.

These and other features, objects and advantages of the invention will be fully appreciated and understood from the following detailed description of the preferred embodiment of the invention, with reference to the accompanying drawings.

DETAILED DESCRIPTION OF THE PREFERRED EMBODIMENTS

Figure 1:
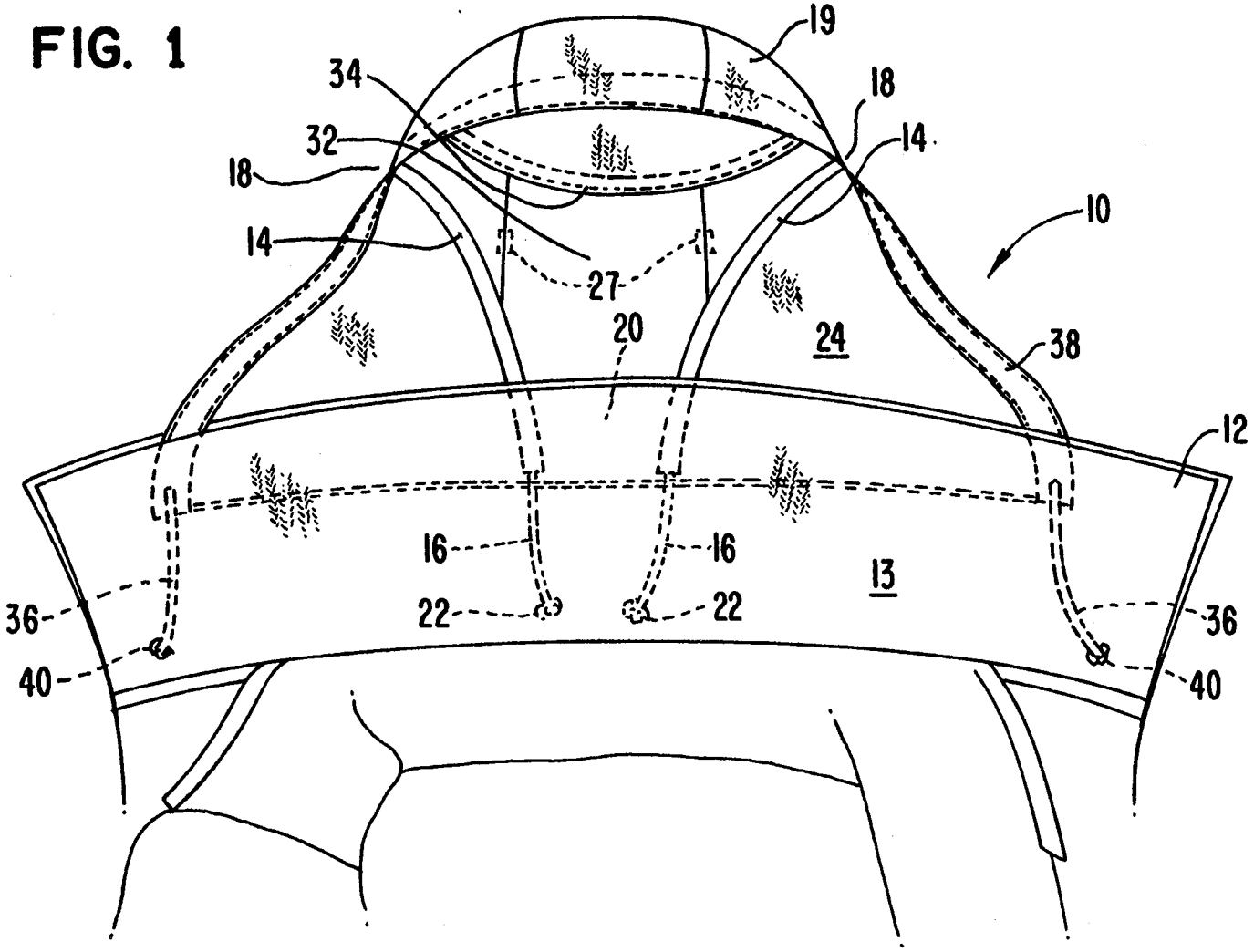
FIG. 1 is a front view of a hood according to the invention.

FIG. 1 shows the interior of a hood 10 in accordance with the present invention. Hood 10 is attached to an upstanding collar 12, behind an inner collar panel 13, and has a pair of arcuate passageways 14 which extend from each temple area 18, along the sides of the crown area 19 to the nape of the neck 20. The crown area of the head refers to the top or highest part of the head beginning just above the ears. A corresponding pair of drawstrings 16 are disposed inside the respective passageways 14, and have one set of ends secured to the hood 10 in the temple areas 18 and free ends exiting eyelets or apertures 22 passing through an outer collar panel 23 at the nape area of the neck 20. The drawstrings 16 are free to move within their respective passageways 14 in response to a pull or release of their free ends.

Figure 2:
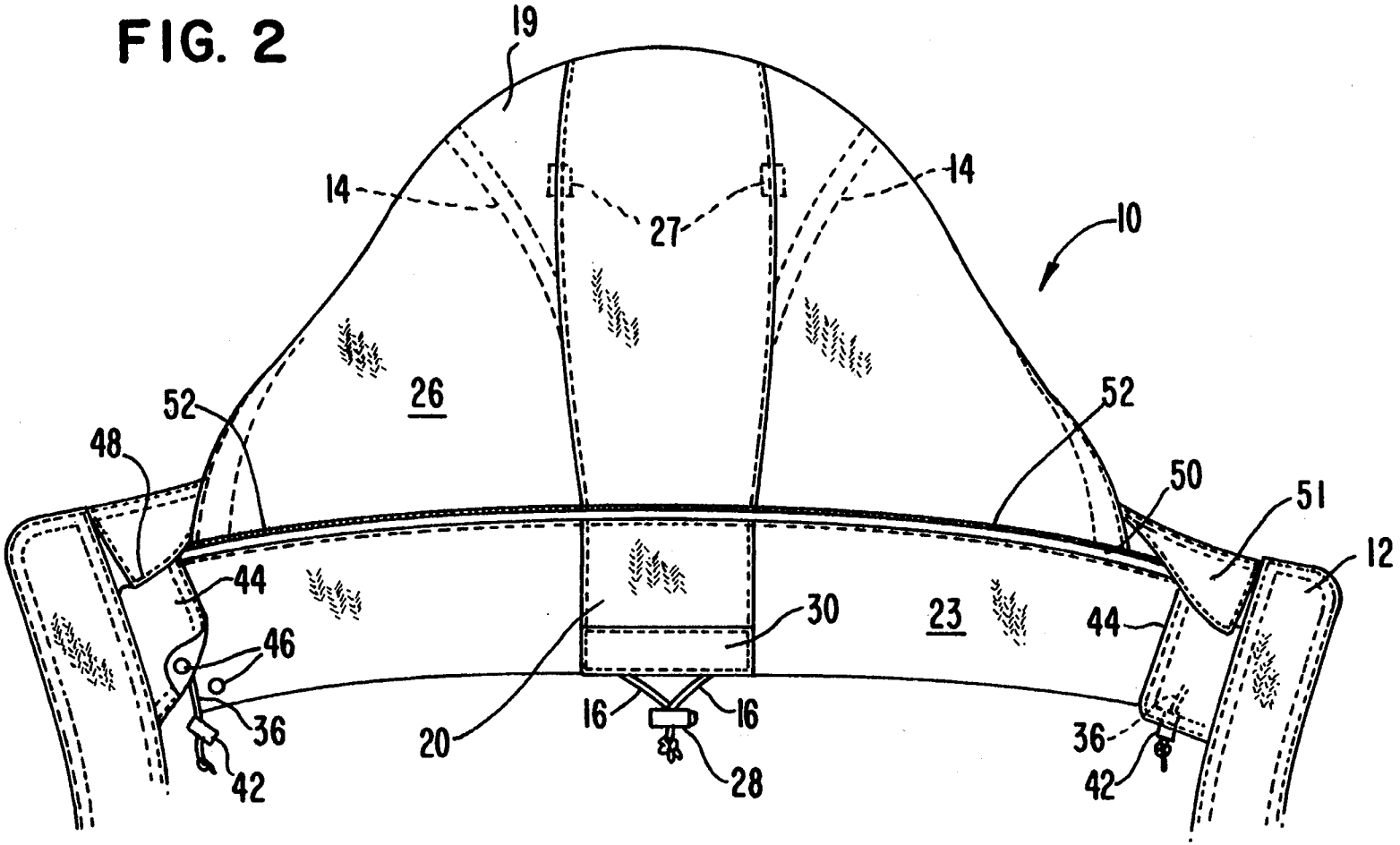
FIG. 2 is a rear view of the hood shown in FIG. 1.

Referring now to FIGS. 1 and 2, the hood 10 is preferably constructed of an inner fabric shell or layer 24 and an outer fabric shell or layer 26, each layer being formed of three separate panels sewn together. Each arcuate passageway 14 is preferably sewn into inner shell 24 as a drawstring casing seam. Inner shell 24 and outer shell 26 should be tacked together, directly or through a short cord or fabric strip, at one or more locations along the seam allowances of the panels to provide movement of both layers during adjustment. It has been found that a single central tack 27 positioned roughly midway along each of the two seam allowances works well for this purpose.

FIG. 2 shows the free ends of drawstrings 16 exiting the interior of the hood 10 through eyelets 22 on collar 12 at the nape of the neck, and hanging free on the back of hood 10. The free ends of drawstrings 16 are contained by an adjustable cordlock 28 of known construction, e.g., of the spring biased type normally biased into a locking condition and releasable by squeezing the ends of the cordlock. A protective flap 30 is disposed on the exterior of collar 12 at the nape of the neck 20, and protects eyelets 22 from adverse elements. Flap 30 may also serve to hide cordlock 28 from view and protect the same.

The lateral and vertical fit of hood 10 is adjusted by squeezing cordlock 28 to free the drawstrings 16, and pulling downwardly the free ends of the drawstrings until the desired hood position is attained. Then, cordlock 28 is positioned at the desired locations along drawstrings 16 and released to re-engage the drawstrings. As the drawstrings are pulled, the hood is gathered along passageways 14, to adjust the size of the hood in both lateral and vertical directions.

The face opening of the hood 10 is generally designated by reference numeral 32 (FIG. 1). Since the secured ends of drawstrings 16 are affixed to the front temple area 18 of hood 10, pulling on the drawstrings will draw the top edge 34 of the hood backward and upward. In particular, pulling drawstrings 16 will pull temple areas 18 of the face opening 32 toward the back of the wearer's head at approximately the wearer's eye level. In this way, the degree of peripheral vision at the temple areas of the hood is adjusted while simultaneously effecting both lateral and vertical adjustment of the hood. Drawstrings 16 are preferably elasticized to provide a snug fit while retaining hood resiliency to accommodate head movements.

Two-way drawstrings 16 of the hood 10 may be provided in addition to an independently operating face opening drawcord 36 extending around the periphery of the face opening 32 in a conventional manner, as shown in FIGS. 1 and 2. The face opening drawcord 36 is disposed in a face opening drawcord passageway 38 formed between inner shell 24 and outer shell 26. Face opening drawcord 36 exits face opening passageway 38 at opposite sides of collar 12, and then passes from the inside to the outside of outer collar panel 23 through eyelets 40. Each end of face opening drawcord 36 may have a cordlock 42 to allow adjustment of the drawcord without having to tie the ends together. Attached to the outside of outer collar panel 23 are side flaps 44 which protectively cover each of the eyelets 40 and conceal cordlocks 42. Side flaps 44 can be secured to the exterior of the collar 12 by conventional snap fasteners 46.

Figure 3:
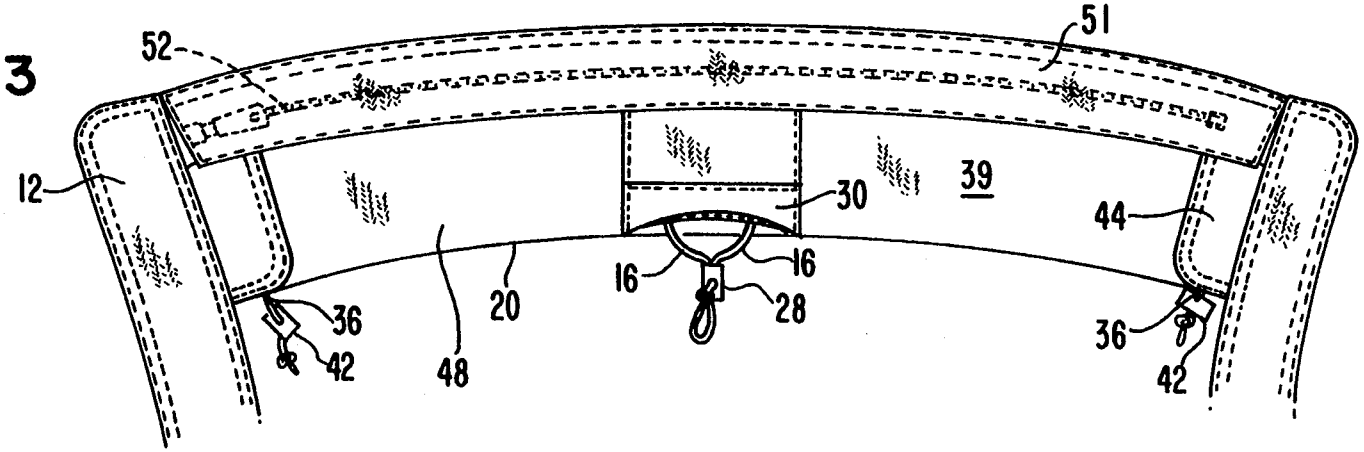
FIG. 3 is a rear view of the upstanding collar enclosing the hood of FIG. 1, with the collar open.
Figure 4:
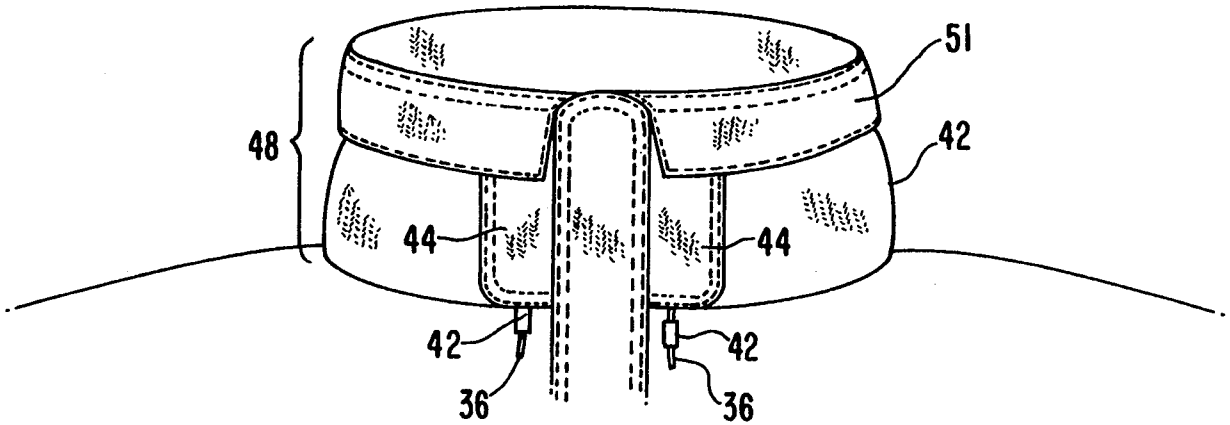
FIG. 4 is a front view of the upstanding collar of FIG. 3 with the collar closed.

In the preferred embodiment of hood 10, upstanding collar 12 forms an integral pouch into which hood 10 can be rolled and inserted when not in use. Specifically, pouch 48 is formed between inner collar panel 13 and outer collar panel 23. Hood 10 is sewn to the inside of outer panel 23 so as to extend, in use, out from between panels 13 and 23. When hood 10 is to be stowed, it is simply rolled or gathered up into pouch 48 defined between panels 13 and 23. In the preferred embodiment, outer collar panel 23 has a circumferentially extending closeable opening 50. Hood 10 extends out from opening 50 of pouch 48 when in use and may be inserted through the opening and into the pouch for storage. Opening 50 may be closeable by a zipper 52 or other known closure means. A collar flap 51 is provided for concealing and protecting zipper 52. FIGS. 3 and 4 illustrate collar 12 with hood 10 contained in pouch 48. FIG. 3 illustrates the back of collar 12 with hood 10 stowed away in pouch 48, and the collar in an open position. FIG. 4 illustrates the front of collar 12 in a closed position with side flaps 44 secured to the collar.

The invention has been described in terms of preferred embodiments thereof. Other embodiments and modifications within the scope and spirit of the invention will occur to those having ordinary skill in the art.

I claim:

1. An adjustable hood system for outerwear, comprising:

at least one panel of flexible material forming a hood in a shape for covering top, back and sides of a wearer's head, and having a face opening for leaving exposed the wearer's face; and a drawstring arrangement for simultaneously adjusting the fit of the hood in both lateral and vertical directions, comprising:

a pair of enclosed arcuate passageways formed in said material and extending from a lower rear portion of the hood corresponding approximately to the nape of the neck of the wearer, to respective upper forward portions of the hood, on opposite sides of the face opening, corresponding approximately to the temple areas of the wearer; and a pair of drawstrings extending along said passageways and being secured at first ends thereof to said hood and extending externally of said passageways at second ends, whereby the fit of said hood may be adjusted by pulling on said second ends of said drawstrings and gathering said hood along said passageways to impart lateral and vertical adjustability.

2. An adjustable hood system according to claim 1, wherein said first ends of said drawstrings are secured to said hood at said upper forward portions thereof, and said second ends extend externally of said passageways at said lower rear portion of the hood.

3. An adjustable hood system according to claim 2, wherein said second ends of said drawstrings are contained by a single adjustable cordlock.

4. An adjustable hood system according to claim 1, wherein said hood comprises an inner and outer layer of fabric material, and said passageways are formed along said inner layer.

5. An adjustable hood system according to claim 4, wherein said passageways are provided by seams formed in said inner layer of fabric material.

6. An adjustable hood system according to claim 4, wherein said inner and outer layers of fabric material are tacked together at a plurality of points about the hood, whereby movement of both layers is obtained during adjustment via said drawstrings.

7. An adjustable hood system according to claim 1, wherein said drawstrings are elasticized.

8. An adjustable hood system according to claim 1, further comprising a face opening drawcord extending within a face opening passageway provided along the periphery of said face opening and exiting said face opening passageway on opposite sides of said hood.

9. An adjustable hood system according to claim 8, wherein said pair of drawstrings are unattached to and function independently of said face opening drawcord.

10. An adjustable hood system according to claim 1, further comprising a collar member forming a pouch into which said hood is stowable.

11. An adjustable hood system according to claim 10, wherein said pouch includes a zipper for closing said pouch and containing said hood.

12. An adjustable hood system for outerwear, comprising:

at least one panel of flexible material forming a hood in a shape for covering the top, back and sides of a wearer's head, and having a face opening for leaving exposed the wearer's face: and a drawstring arrangement for simultaneously adjusting the fit of the hood in both lateral and vertical directions, comprising:

a pair of arcuate passageways formed in said material and extending from a lower rear portion of the hood corresponding approximately to the nape of the neck of the wearer, to respective upper forward portions of the hood, on opposite sides of the face opening, corresponding approximately to the temple areas of the wearer; and a pair of drawstrings extending along said passageways and being secured at first ends thereof to said hood at said upper forward portions thereof, and extending externally of said passageways at second ends thereof at said lower rear portion of the hood, and wherein said second ends of said drawstrings extend through apertures in said lower rear portion of the hood, from an inside to an outside thereof, and said apertures are covered by a protective flap, and whereby the fit of said hood may be adjusted by pulling on said second ends of said drawstrings.

13. An adjustable hood system for outerwear comprising:

a hood attached to a collar, said hood being made of flexible material forming a shape for covering the crown, back and sides of a wearer's head and having a face opening for leaving a portion of the wearer's face exposed; and adjusting means for adjusting the degree of peripheral vision at the temple areas of the hood while simultaneously adjusting the fit of said hood in both lateral and vertical directions, said adjusting means extending approximately from the nape of the neck area of the wearer to the temple areas of the wearer, wherein said adjusting means gathers said flexible material to impart lateral and vertical adjustability to the hood.

14. The adjustable hood system of claim 13, wherein said adjusting means comprises two elongated adjustment members attached to said hood at respective said temple areas and traversing opposite sides of the crown area of the wearer's head.

15. The adjustable hood system of claim 14, wherein said hood comprises an inner and outer layer of fabric material, and said adjustment members extend along said inner layer.

16. The adjustable hood system of claim 14, further comprising a face opening drawcord extending within a face opening passageway provided along the periphery of said face opening and exiting said face opening passageway on opposite sides of said hood.

17. The adjustable hood system of claim 16, wherein said adjusting means is not attached to and functions independently of said face opening drawcord.

18. The adjustable hood system of claim 13, further comprising a collar member forming a pouch into which said hood is stowable.

19. The adjustable hood system of claim 18, wherein said pouch includes a zipper for closing said pouch and containing said hood.

20. The adjustable hood system of claim 13, wherein said adjusting means comprises a drawstring arrangement including a pair of arcuate passageways formed in said material and extending from a lower rear portion of said hood corresponding approximately to the nape of the neck of the wearer, to respective upper forward portions of said hood, on opposite sides of said face opening, corresponding approximately to the temple areas of the wearer, and a pair of drawstrings extending along said passageways and being secured at first ends thereof to said hood and extending externally of said passageways at second ends, whereby the degree of peripheral vision and the fit of said hood may be adjusted by pulling on said second ends of said drawstrings.

21. The adjustable hood system of claim 20, wherein said first ends of said drawstrings are secured to said hood at said upper forward portions thereof, and said second ends extend externally of said passageways at said lower rear portion of said hood.

22. The adjustable hood system of claim 21, wherein said second ends of said drawstrings are contained by a single adjustable cordlock.

23. The adjustable hood system of claim 20, wherein said drawstrings are elasticized.

24. The adjustable hood system of claim 20, wherein said hood comprises an inner and outer layer of fabric material, and said passageways are formed along said inner layer.

25. The adjustable hood system of claim 24, wherein said passageways are provided by respective seams formed in said inner layer of fabric material.

26. The adjustable hood system of claim 25, wherein said inner and outer layers of fabric material are tacked together at a plurality of points about said hood, whereby movement of both layers is obtained during adjustment via said drawstrings.

27. An adjustable hood system for outerwear comprising:

a hood disposed on a collar, said hood being made of flexible material forming a shape for covering the crown, back and sides of a wearer's head and having a face opening for leaving a portion of the wearer's face exposed; and adjusting means for adjusting the degree of peripheral vision at the hood while simultaneously adjusting the fit of said hood in both lateral and vertical directions, said adjusting means extending approximately from the nape of the neck area of the wearer to the temple areas of the wearer, wherein said adjusting means comprises a drawstring arrangement including a pair of arcuate passageways formed in said material and extending from a lower rear portion of said hood corresponding approximately to the nape of the neck of the wearer, to respective upper forward portions of said hood, on opposite sides of said face opening, corresponding approximately to the temple areas of the wearer, and a pair of drawstrings extending along said passageways and being secured at first ends thereof to said hood at said upper forward portions thereof, and extending externally of said passageways at second ends thereof at said lower rear portion of the hood, and wherein said second ends of said drawstrings extend through apertures in said lower rear portion of said hood, from an inside to an outside thereof, and said apertures are covered by a protective flap, and whereby the degree of peripheral vision and the fit of said hood may be adjusted by pulling on said second ends of said drawstrings.

* * * * *